US009333522B2

(12) United States Patent
Hsieh et al.

(10) Patent No.: US 9,333,522 B2
(45) Date of Patent: May 10, 2016

(54) NEBULIZATION STRUCTURE WITH NOZZLE PLATE AND NEBULIZATION APPARATUS THEREOF

(71) Applicants: Shu-Pin Hsieh, Bade (TW); Tun-Ying Fang, Bade (TW); Mei-Hui Huang, Bade (TW); Yu-Ta Chen, Bade (TW)

(72) Inventors: Shu-Pin Hsieh, Bade (TW); Tun-Ying Fang, Bade (TW); Mei-Hui Huang, Bade (TW); Yu-Ta Chen, Bade (TW)

(73) Assignee: MICRO BASE TECHNOLOGY CORPORATION, Taoyuan County (TW)

( * ) Notice: Subject to any disclaimer, the term of this patent is extended or adjusted under 35 U.S.C. 154(b) by 529 days.

(21) Appl. No.: 13/719,171

(22) Filed: Dec. 18, 2012

(65) Prior Publication Data

US 2013/0270358 A1 Oct. 17, 2013

(30) Foreign Application Priority Data

Apr. 16, 2012 (TW) ..... 101207058 U

(51) Int. Cl.
*B05B 17/00* (2006.01)

(52) U.S. Cl.
CPC ..... *B05B 17/0646* (2013.01)

(58) Field of Classification Search
CPC .... B05B 12/09; B05B 17/0607; B05B 17/06; B05B 17/0615; B05B 17/0638; B05B 17/0646
USPC ..... 239/102.2, 338, 370, 102.1
See application file for complete search history.

(56) References Cited

U.S. PATENT DOCUMENTS

2008/0217430 A1* 9/2008 Feriani et al. ..... 239/102.2
2010/0213274 A1* 8/2010 Yu et al. ..... 239/102.2

* cited by examiner

*Primary Examiner* — Arthur O Hall
*Assistant Examiner* — Viet Le
(74) *Attorney, Agent, or Firm* — Leong C. Lei

(57) ABSTRACT

A nebulization structure with a nozzle plate includes a nozzle plate and a driving element. The nozzle plate is composed of a polymer and a support plate, and the support plate includes a plurality of connecting portions and a through hole, and the polymer covers the support plate and has a plurality of penetrating holes corresponding to the through hole. The driving element is coupled to the nozzle plate through the connecting portions for producing a high-frequency vibration wave through a piezoelectric effect after power is supplied and driving the nozzle plate to vibrate and break up the molecular structure of a solution into a mist, so as to achieve the nebulization effect. The nebulization structure can be installed in a nebulization apparatus to achieve a high-efficiency nebulization effect by the nozzle plate and the driving element, so as to facilitate the manufacturing process and save costs.

10 Claims, 5 Drawing Sheets

NEBULIZATION STRUCTURE WITH NOZZLE PLATE AND NEBULIZATION APPARATUS THEREOF

CROSS-REFERENCE TO RELATED APPLICATIONS

This non-provisional application claims priority under 35 U.S.C. §119(a) on Patent Application No(s). 101207058 filed in Taiwan, R.O.C. on Apr. 16, 2012, the entire contents of which are hereby incorporated by reference.

BACKGROUND OF THE INVENTION

1. Field of the Invention

The present invention relates to a improved nebulization structure with a nozzle plate, and more particularly to the nebulization structure with a nozzle plate that uses a nozzle plate and a driving element for its operation.

2. Description of the Related Art

In general, a nebulization structure is commonly used in objects such as sprayers or ink cartridges, and the nebulization structure produces high-frequency vibration waves by the principle of electron vibrations to break up the molecular structure of a solution into mist molecules.

The nebulization structure at an early stage includes a piezoelectric plate and an nebulization plate. The piezoelectric plate is installed on a side of the nebulization plate, and after an electric field is applied to the piezoelectric plate, high-frequency vibration waves are produced, so that the nebulization plate linked by the piezoelectric plate is bent or deformed to produce vibrations to break up the molecular structure of a solution into mist molecules and provide a nebulization effect to spray the mist molecules from a nozzle of the nebulization plate.

Metal can transmit vibration energy better, and the nebulization plate is made of metal. However, the metal may become elastically fatigue easily under the operation with high-speed vibrations for long, so that the metal may become embrittled, and the nebulization plate may have cracks or a low vibration effect to reduce the nebulization effect.

To overcome the problem of the nebulization plate made of metal, a nebulization plate made of a polymer is introduced. Compared with the nebulization plate made of metal, the nebulization plate made of polymer has a longer service life. Since the polymer has a loosened molecular structure and a lower vibration energy transmission effect, the nebulization effect of the nebulization plate made of polymer is lower. To overcome this drawback of the polymer, a structure plate made of metal is added. The nebulization plate is installed between the piezoelectric plate and the structure plate, and the piezoelectric plate is coupled to the structure plate from both sides directly, and the high-frequency vibration produced by the piezoelectric plate can be transmitted to the structure plate directly, and the structure plate drives the nebulization plate to vibrate and produce a nebulization effect.

However, the aforementioned design requires adding the structure plate to drive the nebulization plate to vibrate, and thus incurring a higher cost. Therefore, the inventor of the present invention simply uses a piezoelectric plate combined with a nebulization plate made of polymer to overcome the aforementioned drawbacks of the nebulization structure.

SUMMARY OF THE INVENTION

In view of the problems of the prior art, it is a primary objective of the present invention to provide a nebulization structure with a nozzle plate having the features of a simplified manufacturing process, a low cost, and a high-efficiency nebulization effect. The nebulization structure with a nozzle plate of the present invention comprises a nozzle plate and a driving element, wherein the nozzle plate is comprised of a polymer and a support plate, and the polymer is covered onto the support plate, so that the nozzle plate can be driven by the driving element to produce a resonance to break up the molecular structure of a solution into small mist molecules, so as to achieve the nebulization effect. Compared with the conventional nebulization structure, the present invention can avoid the issue of the nebulization plate made of metal that may be cracked easily, while maintaining the advantage of the long service life of the nebulization plate made of a polymer, and overcoming the problem of requiring an additional structure plate, so as to achieve the effects of simplifying the manufacturing process of the nebulization structure with a nozzle plate and reducing the cost.

To achieve the foregoing objective, the present invention provides a nebulization structure with a nozzle plate capable of producing a nebulization effect of a solution after power is supplied, and the nebulization structure comprises a nozzle plate which is a sheet structure, comprised of a polymer and a support plate, and the polymer is made of polyimide and covered onto at least one surface of the support plate, and the support plate is made of metal and includes a plurality of connecting portions and a through hole, and the polymer having a plurality of penetrating holes formed at positions corresponding to the through hole; and a driving element, installed at the connecting portion, and electrically coupled to an electric power source for producing a piezoelectric effect after power is supplied to drive the support plate together with the polymer to produce a resonance, so as to break up the solution into small molecules.

Wherein, the driving element is a piezoelectric ceramic plate.

Wherein, the support plate has a plurality of ribs installed in the through hole, and the ribs are arranged alternately or in parallel with one another, and the polymer is not filled between the ribs.

In a preferred embodiment, the connecting portions are not covered by the polymer.

In a preferred embodiment, the connecting portions are protruded from a surface of the polymer, and the connecting portions have a height greater than or equal to the thickness of the polymer.

Wherein, the nebulization structure with a nozzle plate is installed in a nebulization apparatus, and the nebulization apparatus comprises a nebulization base, and the nebulization base has a containing portion corresponding to the nozzle plate and the driving element for disposing the nozzle plate and the driving element.

DETAILED DESCRIPTION OF THE PREFERRED EMBODIMENTS

The technical contents of the present invention will become apparent with the detailed description of preferred embodiments and the illustration of related drawings as follows.

Figure 1:
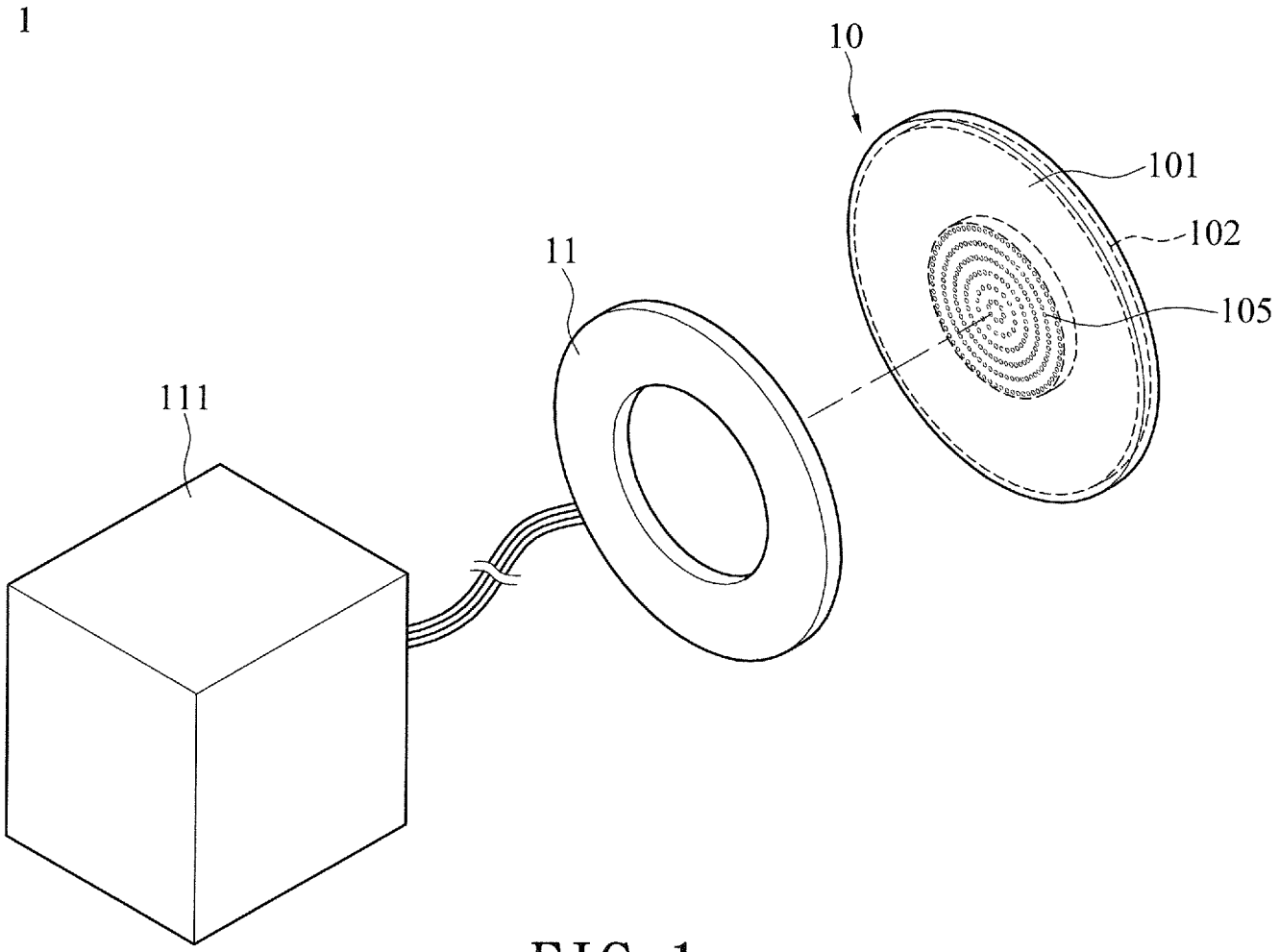
FIG. 1 is a perspective view of a first preferred embodiment of the present invention.
Figure 2:
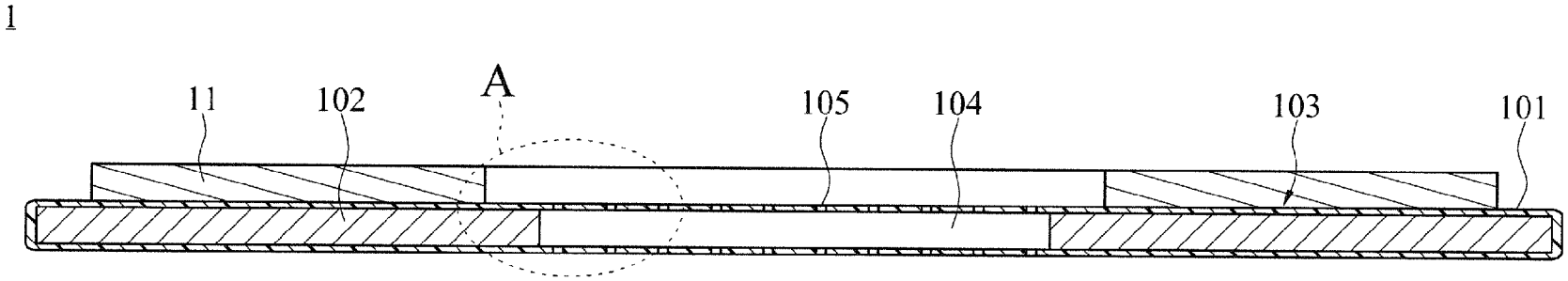
FIG. 2 is a cross-sectional view of the first preferred embodiment of the present invention.
Figure 3:
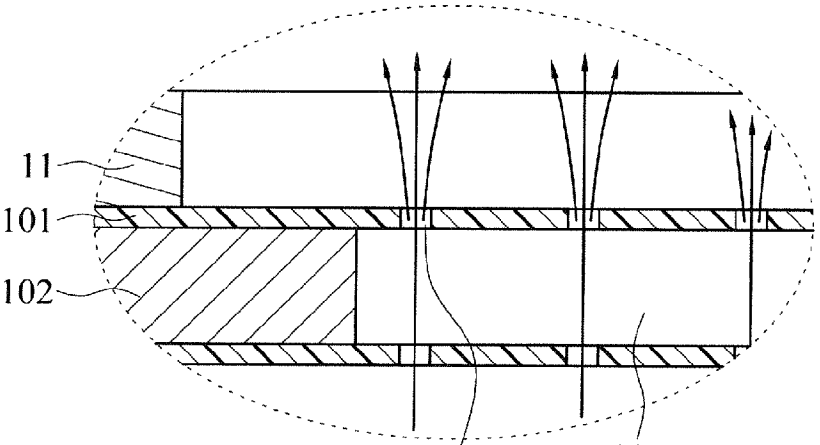
FIG. 3 is a detailed cross-sectional view of the first preferred embodiment of the present invention.

With reference to FIGS. 1 to 3 for a perspective view, a cross-sectional view and a detailed blow-up cross-sectional view of a nebulization structure with a nozzle plate in accordance with the first preferred embodiment of the present invention respectively, the nebulization structure with a nozzle plate 1 capable of breaking up the molecular structure of a solution into smaller mist molecular structures after power is supplied. The nebulization structure comprises a nozzle plate 10 and a driving element 11.

The nozzle plate 10 is preferably a sheet structure comprised of a polymer 101 and a support plate 102, and the support plate 102 is a sheet structure made of metal and includes a plurality of connecting portions 103 and a through hole 104 formed thereon. The connecting portions 103 are provided for connecting the driving element 11 to drive the nozzle plate 10 to operate, and the through hole 104 is used for passing the solution, and the nozzle plate 10 breaks up the molecular structure to small mist molecular structures to achieve the nebulization effect. The polymer 101 is covered onto at least one surface of the support plate 102. In this preferred embodiment, the whole support plate 102 is covered by the polymer 101, and the polymer 101 is very thin. Since the polymer 101 is covered onto the whole of the support plate 102, therefore a plurality of penetrating holes 105 are formed on both front and back sides of the polymer 10 corresponding to the through hole 104 for spraying the molecular structures after the solution is nebulized. Preferably, the polymer 101 is polyimide, which can extend the service life of the nozzle plate 10 and prevent the nozzle plate 10 from being embrittled or cracked easily after a long time of use.

The driving element 11 is installed on the connecting portions 103 for coupling to the nozzle plate 10, and electrically coupled to an electric power source 111. Preferably, the driving element 11 is a piezoelectric ceramic plate. The driving element 11 produces high-frequency vibration waves by a piezoelectric effect after electric power is supplied, and transmits the vibration waves to the nozzle plate 10 to produce a resonance as shown in FIG. 3, and the solution enters from the penetrating holes 105 formed on the back side of the polymer 101, and after the resonance effect breaks up the molecular structure into smaller molecular structures, the smaller molecular structures are sprayed from the penetrating holes 105 formed on the front side of the polymer 101 to achieve a high-efficiency nebulization effect.

Figure 4:
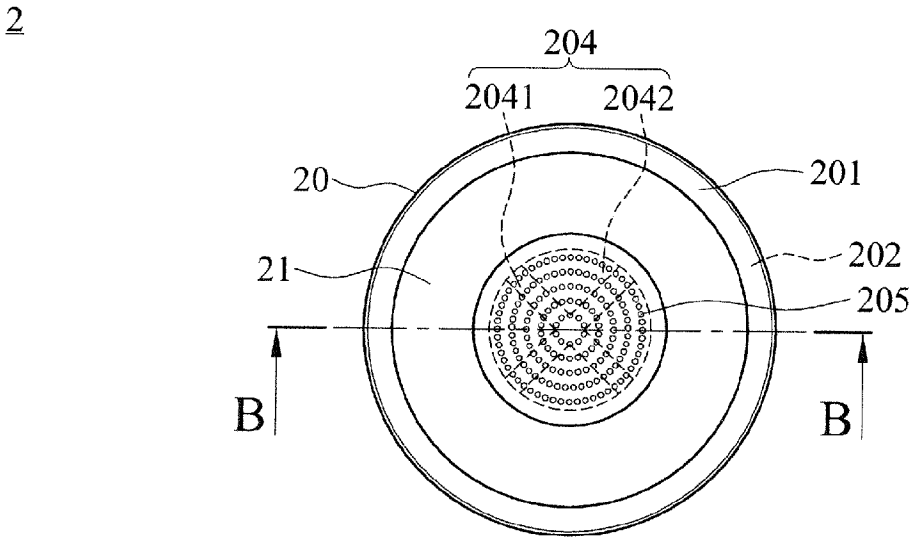
FIG. 4 is a schematic planar view of a second preferred embodiment of the present invention.
Figure 5:
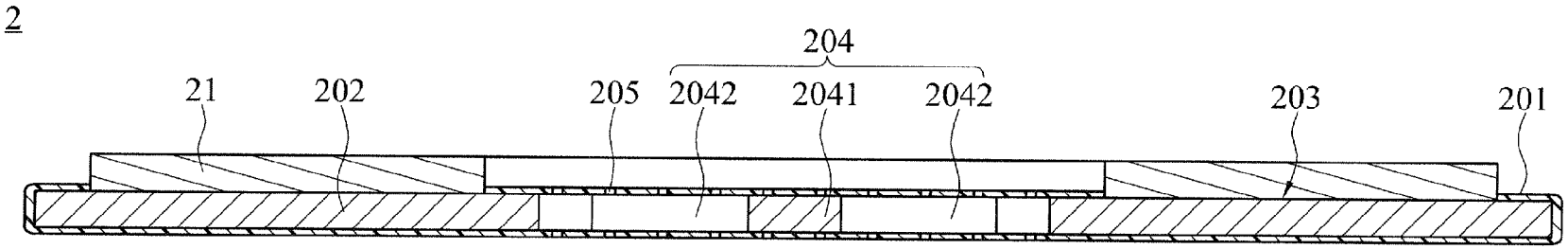
FIG. 5 is a cross-sectional view of the second preferred embodiment of the present invention.

With reference to FIGS. 4 and 5 for a schematic view and a cross-sectional view of the second preferred embodiment of the present invention respectively, the components and structure of this preferred embodiment are the same as those of the first preferred embodiment, and thus will not be repeated. The nebulization structure with a nozzle plate 2 of the present invention comprises a nozzle plate 20 and a driving element 21.

The nozzle plate 20 is a sheet structure comprised of a polymer 201 and a support plate 202, and the support plate 202 includes a plurality of connecting portions 203 and a through hole 204 formed thereon. A plurality of penetrating holes 205 are formed on the front side and the back side of the polymer 201 and at positions corresponding to the through hole 204.

Wherein, the support plate 202 is covered by the polymer 201, but the connecting portions 203 is not covered by the polymer 201. In other words, the polymer 201 is covered on the support plate 202 and at the positions of the connecting portions 203 only. In this preferred embodiment, a plurality of ribs 2041 are installed in the through hole 204, and the ribs 2041 are arranged alternately with one another, but the present invention is not limited to such arrangement only. The ribs 2041 divide the through hole into a plurality of vias 2042, and the polymer 201 is not filled into the vias 2042.

The driving element 21 is installed at the connecting portions 203 for coupling to the nozzle plate 20 and in direct contact with the nozzle plate 20, and electrically coupled to an electric power source (not shown in the figure), so that the driving element 21 can produce high-frequency vibration waves and transmit the vibration waves to the nozzle plate 20 to produce a resonance and achieve a nebulization effect.

Figure 6:
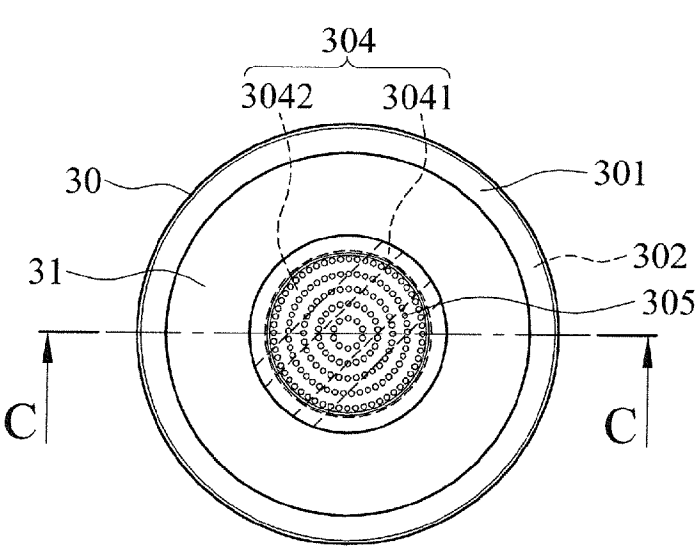
FIG. 6 is a schematic planar view of a third preferred embodiment of the present invention.
Figure 7:
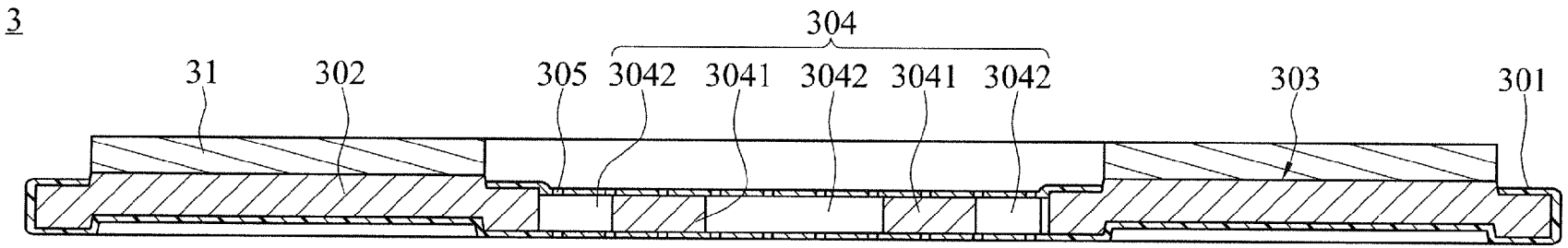
FIG. 7 is a cross-sectional view of the third preferred embodiment of the present invention.
Figure 8:
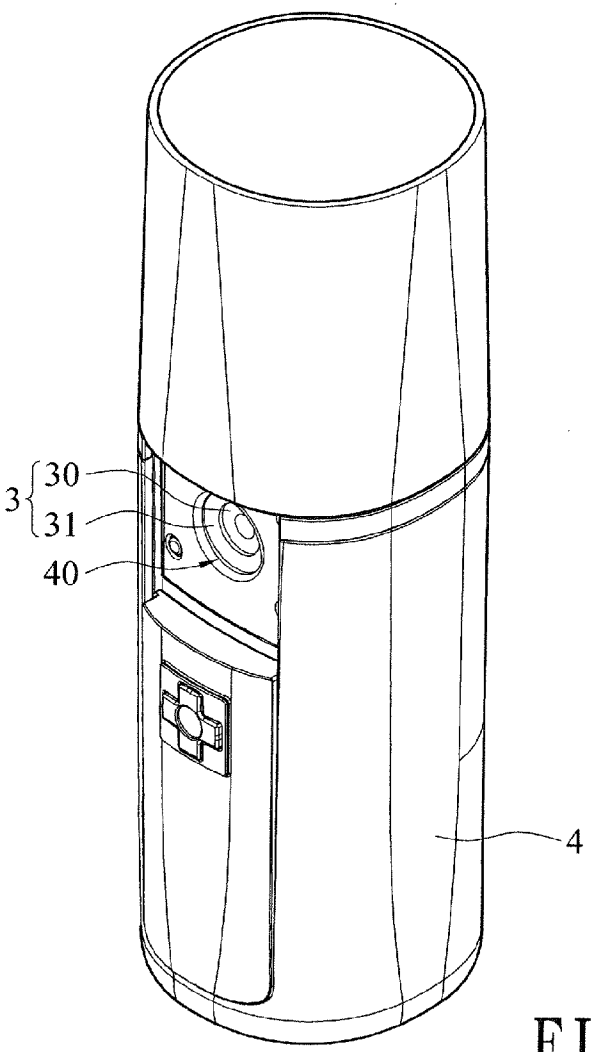
FIG. 8 is a schematic view of an assembly of the third preferred embodiment of the present invention.

With reference to FIGS. 6, 7 and 8 for a schematic view, a cross-sectional view and a perspective view of the third preferred embodiment of the present invention respectively, the components and structure of this preferred embodiment are the same as those of the first and second preferred embodiments, and thus will not be repeated. The nebulization structure with a nozzle plate 3 of the present invention comprises a nozzle plate 30 and a driving element 31.

The nozzle plate 30 is a sheet structure comprised of a polymer 301 and a support plate 302, and the support plate 302 has a plurality of connecting portions 303 and a through hole 304 formed thereon. A plurality of penetrating holes 305 are formed on the front side and the back side of the polymer 301 and at positions corresponding to the through hole 304.

Wherein, the support plate 302 is covered by the polymer 301, but the connecting portions 303 are not covered by the polymer 301. The connecting portions 303 are protruded from a surface of the polymer 301 and have a height greater than the thickness of the polymer 301. In this preferred embodiment, a plurality of ribs 3041 are installed in the through hole 304 and the ribs 3041 are arranged parallel to one another, but the present invention is not limited to such arrangement only. The ribs 3041 divide the through hole 304 into a plurality of vias 3042, and the polymer 301 is not filled into the vias 3042.

The driving element 31 is installed at the connecting portions 303 to couple the nozzle plate 30, and in direct contact with the nozzle plate 30, and electrically coupled to an electric power source (not shown in the figure), so that the driving element 31 can produce high-frequency vibration waves and transmit the vibration waves to the nozzle plate 303 to produce a resonance and achieve a nebulization effect.

Wherein, the nebulization structure with the nozzle plate 3 is installed in a nebulization apparatus, and the nebulization apparatus comprises a nebulization base 4. The nebulization base 4 includes a containing portion 40 corresponding to the nebulization structure with the nozzle plate 3 for disposing the nebulization structure with the nozzle plate 3.

The nebulization structure with the nozzle plate 1, 2, 3 of the present invention simply uses a nozzle plate 10, 20, 30 and a driving element 11, 21, 31 to achieve a high-efficiency nebulization effect. The present invention uses the polymer 101, 201, 301 to cover the nozzle plate 10, 20, 30 installed on the support plate 102, 202, 302, and the driving element 11, 21, 31 drives the nozzle plate 10, 20, 30 to produce a resonance to break up the molecular structure of the solution into small mist molecules, so as to achieve a nebulization effect. Compared with the conventional nebulization structure, the present invention has the advantages of a simpler manufacturing process, a lower cost and a better nebulization effect.

What is claimed is:

1. A nebulization structure, comprising:

a nozzle plate, being a sheet structure, comprised of a polymer and a support plate, and the polymer completely encompassing the support plate, wherein the support plate is a sheet structure made of metal and the support plate includes a plurality of connecting portions and a through hole, and the polymer having a plurality of penetrating holes formed at positions corresponding to the through hole; and a driving element, installed at the connecting portion, and electrically coupled to an electric power source for producing a piezoelectric effect after power is supplied to drive the support plate together with the polymer to produce a resonance, so as to break up the solution into small molecules, and a liquid is repelled through the plurality of penetrating holes of the polymer.

2. The nebulization structure with the nozzle plate according to claim 1, wherein a plurality of ribs are installed in the through hole and the polymer is not filled between the ribs.

3. The nebulization structure with the nozzle plate according to claim 2, wherein the ribs are arranged parallel to one another.

4. The nebulization structure with the nozzle plate according to claim 2, wherein the ribs are arranged alternately with one another.

5. The nebulization structure with the nozzle plate according to claim 1, wherein the driving element is a piezoelectric ceramic plate.

6. The nebulization structure with the nozzle plate according to claim 1, wherein the polymer is polyimide.

7. The nebulization structure with the nozzle plate according to claim 1, wherein the connecting portions are not covered by the polymer.

8. The nebulization structure with the nozzle plate according to claim 7, wherein the connecting portions are protruded from a surface of the polymer.

9. The nebulization structure with the nozzle plate according to claim 8, wherein the connecting portions have a height greater than the thickness of the polymer.

10. A nebulization apparatus applied to the nebulization structure with the nozzle plate according to claim 1, comprising:

a nebulization base, having a containing portion corresponding to the nozzle plate and the driving element, for disposing the nozzle plate and the driving element.

* * * * *